US005220393A

United States Patent [19]

Otomo

[11] Patent Number: 5,220,393

[45] Date of Patent: Jun. 15, 1993

[54] COPYING APPARATUS INCLUDING AN AUXILIARY FRAME

[75] Inventor: Naoki Otomo, Otsuki, Japan

[73] Assignee: Konica Corporation, Tokyo, Japan

[21] Appl. No.: 825,077

[22] Filed: Jan. 24, 1992

[30] Foreign Application Priority Data

Jan. 31, 1991 [JP] Japan ..... 3-011036

[51] Int. Cl.[5] ..... G03G 21/00

[52] U.S. Cl. ..... 355/308; 355/75; 355/231

[58] Field of Search ..... 355/308, 309, 320, 321, 355/230, 231, 72, 75, 76; 271/3, 3.1, 4, 10

[56] References Cited

U.S. PATENT DOCUMENTS 4,097,145 6/1978 Luperti et al. ..... 355/75
4,439,036 3/1984 Davis et al. ..... 355/75
4,520,977 6/1985 Holzhauser et al. ..... 355/231 X
4,645,328 2/1987 Shiraki et al. ..... 355/233
4,853,750 8/1989 Murata et al. ..... 355/75
5,003,347 3/1991 Kameda ..... 355/75
5,008,714 4/1991 Higashio et al. ..... 355/309 X
5,033,728 7/1991 Miura et al. ..... 271/3

*Primary Examiner*—A. T. Grimley
*Assistant Examiner*—William J. Royer
*Attorney, Agent, or Firm*—Finnegan, Henderson, Farabow, Garrett & Dunner

[57] ABSTRACT

In a copying apparatus provided with an automatic document feeder thereon, the automatic document feeder is installed above a platen glass and is openable and closable with respect to the platen glass which is provided on a frame of the copying apparatus. The automatic document feeder is fixed by a plural fixing brackets to both ends of the frame through an auxiliary frame. The rear side of the automatic document feeder is pivotally mounted to the apparatus and the front side is opened and closed.

4 Claims, 3 Drawing Sheets

COPYING APPARATUS INCLUDING AN AUXILIARY FRAME

BACKGROUND OF THE INVENTION

The present invention relates to a structure by which an automatic document feeder (hereinafter, referred to as ADF) is installed to a copying apparatus.

In conventional copying apparatus, when a plurality of documents are copied, it is inefficient to put the document on a document exposure portion one sheet by one sheet. Therefore, the ADF by which the document is automatically fed to the exposure portion, is used. The ADF is inefficient when one sheet of document is copied, and in this case, it is better that the ADF is lifted up, and the document is directly put on a platen glass of the document exposure portion. Therefore, the ADF is frequently lifted up or closed depending on the number of document sheets. Generally, the ADF has a belt to feed documents, rollers, a driving source, and the like therein, and its weight is about 7 to 10 Kg. The ADF is pivotally provided to the apparatus either at one side, and the other side is lifted, or at the rear side, and the front side is lifted. The ADF, whose weight is 7 to 10 kg as described above, is a device by which a document is fed to the exposure portion, and therefore, it is inevitably fixed directly to a frame of an optical system. The frame of the optical system is separately manufactured from a main body of the apparatus for the purpose of providing a platen glass, a moving exposure lamp, reflector mirrors, and a lens thereto, and since a driving means for the exposure lamp and reflector mirrors must be provided to its sides, cut-out portions or the like are provided thereon. The platen glass, the exposure lamp, and the reflector mirrors are accurately provided to the optical frame manufactured separately, and since it is structured so that a document image can be exposed and a latent image can be formed on an image carrier, distortion of the optical path may be caused when the optical frame is deformed by external force, so that an accurate latent image cannot be formed. When the ADF is directly provided to the optical frame as described above, bending moment, or oscillation can occur at the portion where the ADF is pivotally provided, and is transmitted to the optical frame when the ADF is opened and closed forcibly, a portion or all of the optical frame can be deformed, and thus the optical path is distorted as described above, and accurate image formation can not be performed.

SUMMARY OF THE INVENTION

The above described problems can be solved by the present invention structured in such a manner that: ADF mounting frames are provided in a plurality of places on an optical frame in the moving direction of an exposure lamp; and ADF fixing brackets are mounted on the mounting frame so that the ADF can be provided in a predetermined position of the copying apparatus, and thereby bending moment caused by an opening and closing operation of the ADF can not be transmitted directly to the optical frame.

The object of the present invention is to provide a copying apparatus characterized in that: in the copying apparatus comprising a frame on which a platen glass is provided, and an automatic document feeder (ADF) which can be provided on the platen glass, wherein the ADF can be opened and closed with respect to the platen glass, the ADF is fixed to fixing brackets which are fixed to both end portions of the frame.

DESCRIPTION OF THE PREFERRED EMBODIMENT

Figure 3:
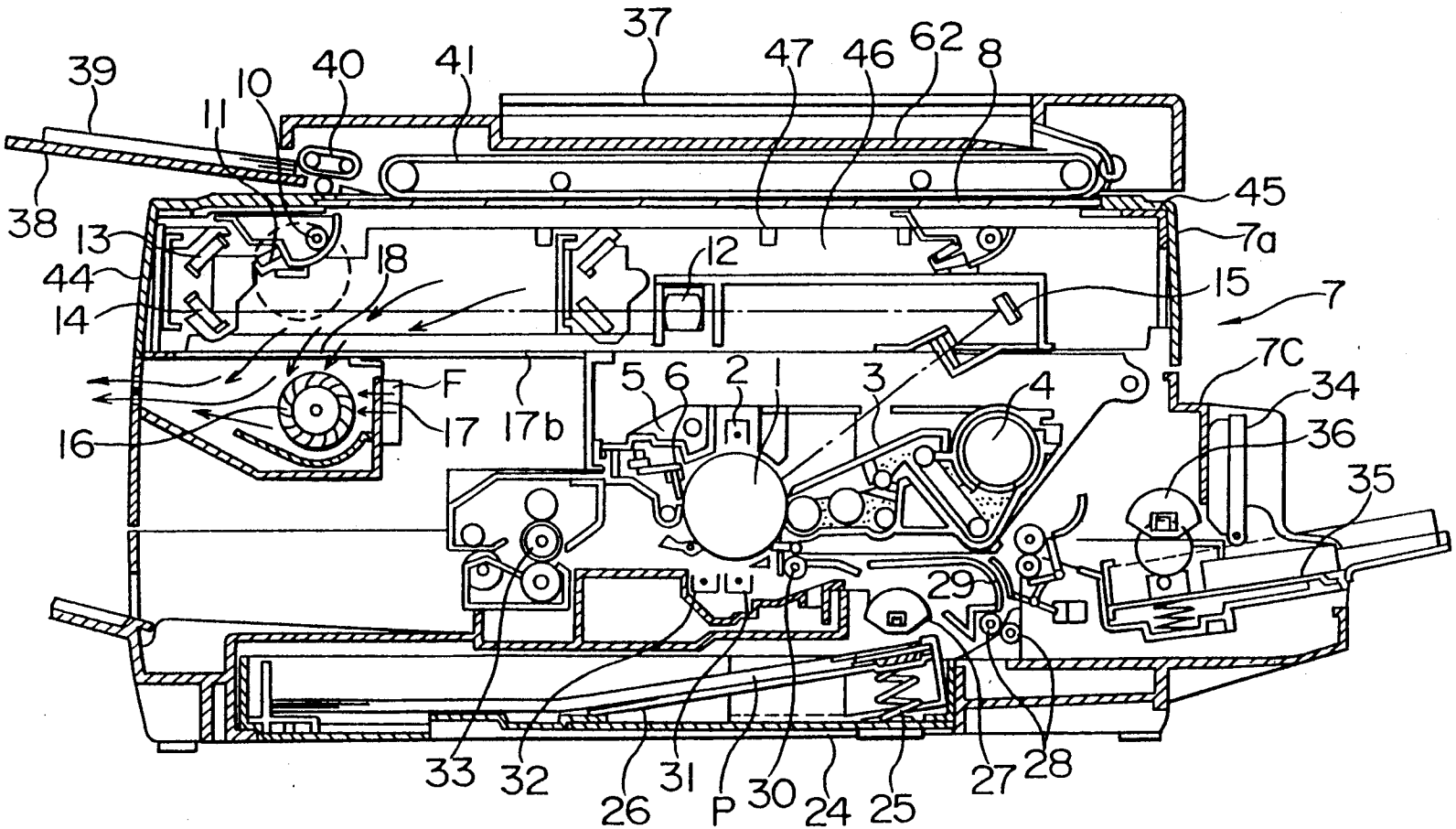
FIG. 3 is a sectional view showing a structure of the copying apparatus and the ADF.

FIG. 3 is a view showing an overall structure of a copying apparatus. In FIG. 3, numeral 1 is a photosensitive drum, numeral 2 is a charging electrode which charges the overall surface of the photosensitive drum 1 with a constant electric charge, numeral 3 is a developing device provided with a toner supply unit 4, and numeral 5 is a cleaning device provided with a cleaning blade 6 which removes residual toner from the photosensitive drum 1. The above described units are integrally structured, and detachably provided to an upper frame *7a* of the copying apparatus 7. Further, in the upper frame *7a*, a platen glass 8 on which a document is put, an exposure lamp 10 which is moved on a guide rail (not shown) to a position shown by a one-dot-chain line in the drawing below the platen glass 8 in the upper frame *7a*, a first reflector mirror 11 which is moved integrally with the exposure lamp 10, an integrally provided V-mirrors 13 and 14 projecting the light received from the first reflector mirror 11 to a focusing lens 12, and a fixed mirror 15 which exposes the surface of the photosensitive drum 1 and forms a latent image thereon, are provided. Numeral 16 is a exhaust fan which exhausts the heat generated in the copying apparatus to the outside of the apparatus, air inlet ports 17 and 18 are provided to the apparatus, and the inlet port 17 exhausts toner scattering from the developing device 3, and ozone generated from the charging electrode 2 through ozone removal filter F to the outside of the apparatus. Furthermore, the apparatus is structured in a manner that: heat of the exposure lamp generated in an upper optical system is exhausted from the inlet port 18 which is formed on a shading plate 17*b* for shading the optical system, to the outside of the apparatus. With regard to a moving distance of the exposure lamp 10, the V-mirrors 13 and 14 are moved on the guide rails by a half distance thereof so that the optical path length between a document and the surface of the photosensitive drum 1 can be kept constant.

Numeral 24 is a sheet feed cassette which is provided to a lower portion of a lower frame *7c* of the copying apparatus 7 and in which a recording paper P is accommodated. The recording paper accommodated in the sheet feed cassette 24 is conveyed in a manner in which: a front portion of the recording paper in the sheet feed direction is pushed up through a pressure plate 26 by a spring 25; the uppermost recording paper P is fed through a semi-circular sheet feed roller 27; and the recording paper is conveyed through a roller 28 and a guide 29 to a second sheet feed roller section 30. The second sheet feed roller 30 is rotated in a manner in which: the recording paper P which stops once at the second sheet feed roller 30, can be synchronized with a toner image which is developed by the developing device 3 on the surface of the photosensitive drum 1. Numeral 31 is a transfer electrode which transfers a toner image formed on the surface of the photosensitive drum 1, onto the recording paper P, numeral 32 is a separation electrode which separates the recording paper P from the surface of the photosensitive drum 1, and numeral 33 is a fixing unit which fixes the toner image which has been transferred onto the recording paper P. In the lower frame *7c*, a one-sheet manual feeding unit 34 and a plural sheet manual feeding unit 35 are provided, from which sheets are fed through a semicircular sheet feed roller 36 respectively.

The ADF 37 is provided on the top of the copying apparatus 7 as shown in FIG. 3. Numeral 38 is a document tray, numeral 39 is a document, numeral 40 is a document feeding device which separates the document 39 one sheet by one sheet, and numeral 41 is a conveyance belt which receives the document 39 conveyed from the document feeding device 40, and conveys it to a predetermined exposure portion of the platen glass 8. After exposure has been completed, the document 39 is discharged to a sheet discharging section 62 through the conveyance belt 41.

Figure 1:
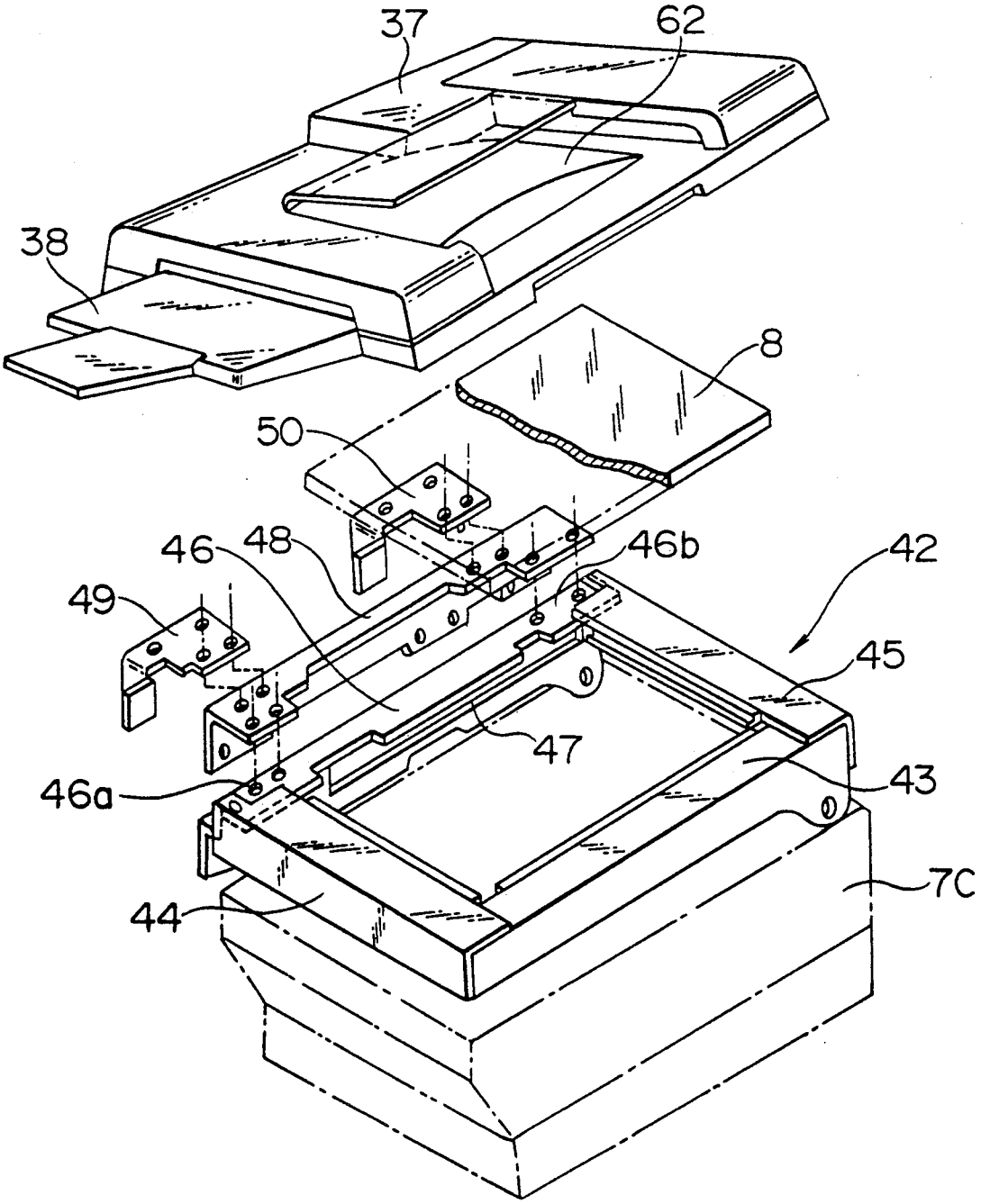
FIG. 1 is an exploded perspective view showing mounting of an ADF on a copying apparatus.
Figure 2:
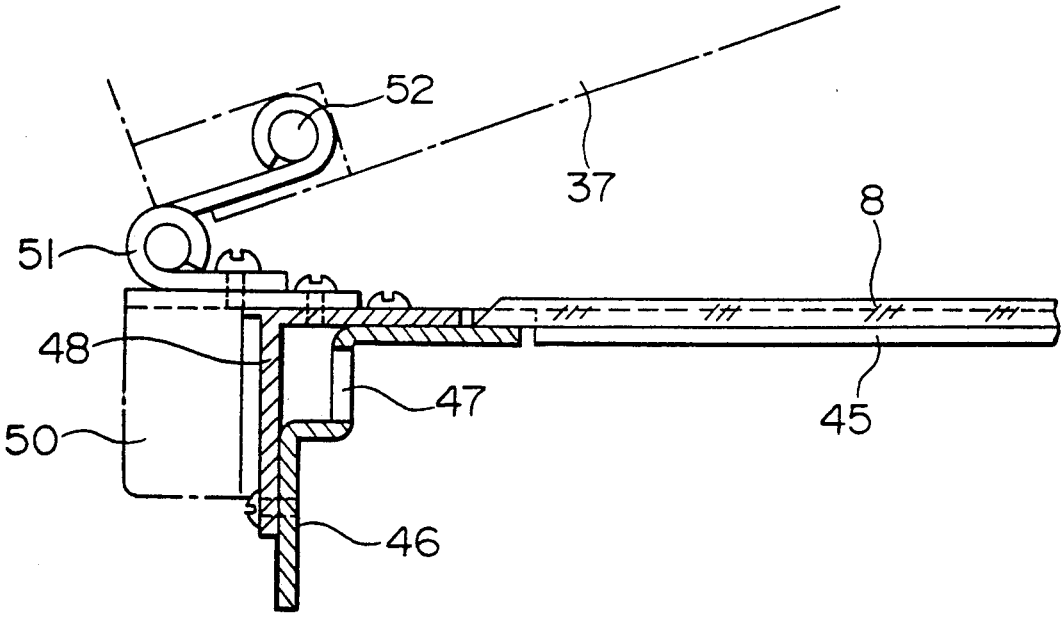
FIG. 2 is a sectional view showing the above mounting.

FIG. 1 and FIG. 2 show a condition in which the ADF 37 is mounted to the upper frame *7a*.

Numeral 42 is a frame which composes a portion of the upper frame *7a*, and is almost square when viewed from a horizontal plane, and is composed of a front frame 43, side frames 44 and 45, and a rear frame 46. The platen glass 8 is placed on the frame. The rear frame 46 is fixed to the rear end portion of the side frame 44 and 45 by screws or welding. A slot 47 is formed on the rear frame 46, and the hole is provided for an allowance when the exposure lamp 10, the first reflector mirror 11, and V-mirrors 13 and 14 are driven. Numeral 48 is an L-shaped auxiliary frame which is provided on the upper portion and side portions of the rear frame 46, and is fixed on only both side portions 46*a* and 46*b* by screws or welding, and on which fixing brackets 49 and 50, by which the ADF 37 is mounted, are fixed by screws or welding. FIG. 2 shows a condition in which the ADF 37 is mounted to the fixing brackets 49 and 50. The ADF 37 is fixed at two portions respectively on the fixing brackets 49 and 50 by hinges. The ADF 37 is rotatably provided by a shaft 52 to a mounting portion of a tip of the hinge; and a mounting portion of the ADF 37 can be raised up when book-copying is conducted.

The frame 42 is structure so that it can be rotatably opened around its one end axis against the lower frame *7c* of the copying apparatus 7.

Since the present invention is structured as above, when a copying operation is started, only one sheet of the documents 39 on the tray 38 of the ADF 37 is separated, conveyed to a gap between the conveyance belt 41 and platen glass through the document feeding device 40, conveyed to a predetermined position on the platen glass 8 by the conveyance belt 41, and stopped. At the same time, the document 39 is exposed by the exposure lamp 10, and the surface of the photosensitive drum 1 which has been charged by the charging electrode 2, is exposed through the first reflector mirror 11, V-mirrors 13 and 14, a focusing lens 12, and a fixed mirror 15, and a latent image is formed on the surface of the photosensitive drum 1. Then the latent image is developed by the developing device 3, and a toner image is formed. The recording paper P is fed by the roller 27 and the second sheet feed roller 30 so that the recording paper P can be synchronized with the toner image, the toner image is transferred onto the recording paper P by the transfer electrode 31, the recording paper P is separated from the surface of the photosensitive drum 1 by the separation electrode 32, and then fixed by the fixing unit 34, and the copying operation is completed. In the case described above, in which many documents are to be copied, the copying operation is conducted by using the ADF 37. On the other hand, when the number of document sheets is one or very few, or when a large document, to which the ADF 37 can not be applied, is copied, the ADF 37 is lifted by the hinge 51 as shown in FIG. 2. When the ADF 37 is lifted, the apparatus is structured so that the ADF can not be dropped by a balance spring (not shown) provided to the hinge 51 section. As described above, the ADF 37 can be opened or closed depending on the condition of use. When unnatural rotation, such as an excessive lift of the ADF 37, is conducted, fixing brackets 49 and 50 are lifted through the hinge 51, and then some rotation force is transmitted to the auxiliary frame 48. However, it is not transmitted to the frame 42 to which the optical system is mounted, so that the position of the platen glass 8 and the optical system can not be influenced thereby. Even when an abrupt opening and closing operation of the ADF 37 is conducted in the exposure process, bending moment is dispersed by the hinge 51 from the fixing brackets 49 and 50 to both ends of the auxiliary frame 48, so that the action of the force to the frame 42 is lightened. Especially, oscillation can be prevented so that the slot 47, which is a weak portion of the middle portion of the frame 42, can be protected.

In the present invention, the ADF 37 is mounted on the frame 42, inside which the optical system is mounted, through a plurality of frames or the auxiliary frame, and thereby influence caused by an opening and closing operation of the ADF 37 is lightened. The present invention has the following superior effects in which: even when the ADF 37 is lifted by a somewhat unnatural opening and closing operation, the main body of the copying apparatus 7 is not influenced; and even when the ADF 37 is opened or closed during the operation of the copying apparatus 7, the image quality is not influenced.

What is claimed is:

1. A copying apparatus comprising:

a platen on which a document can be placed, a frame on which the platen is provided, said frame including a front frame portion, two side frame portions and a rear frame portion, an automatic document feeder above the platen and the frame, including at least one hinge fixed thereto, auxiliary frame means between the frame and the automatic document feeder, the auxiliary frame means being fixed to said frame at said rear frame portion.

2. The copying apparatus of claim 1 further having a plurality of brackets mounted on the auxiliary frame, wherein the automatic document feeder is mounted through said at least one hinge to the plurality of brackets.

3. A copying apparatus as claimed in claim 1 further having driven optical components wherein the rear frame portion includes a slot to allow driving of the driven components.

4. A copying apparatus as claimed in claim 3 wherein said driven optical components include an exposure lamp, a reflector and a mirror.

* * * * *